United States Patent [19]

Baus

[11] 4,228,560

[45] Oct. 21, 1980

[54] LOWER GUIDE FOR A SLIDING PARTITION

[76] Inventor: Heinz-Georg Baus, Ulmenweg 46, 3601 Thun, Switzerland

[21] Appl. No.: 952,676

[22] Filed: Oct. 19, 1978

[30] Foreign Application Priority Data

Oct. 22, 1977 [DE] Fed. Rep. of Germany ..... 2747480

[51] Int. Cl.[2] ..... A47H 15/00

[52] U.S. Cl. ..... 16/90; 16/96 R; 49/411; 49/454; 49/455; 49/471; 4/557; 4/607

[58] Field of Search ..... 16/87 R, 87 B, 90, 91, 16/93 R, 94 R, 96 R; 49/407, 408, 409, 410, 411, 454, 455, 471, 504; 160/197, 202; 4/146, 148, 149, 154

[56] References Cited

U.S. PATENT DOCUMENTS

| | | | |
|---|---|---|---|
| 2,726,420 | 12/1955 | Kemp | 16/87 R |
| 2,754,535 | 7/1956 | Plemeng | 16/87 R |
| 3,896,508 | 7/1975 | Doan | 4/149 |
| 4,090,265 | 5/1978 | Baus | 49/410 X |

FOREIGN PATENT DOCUMENTS

| | | | |
|---|---|---|---|
| 2258179 | 5/1974 | Fed. Rep. of Germany | 16/91 |
| 816746 | 5/1937 | France | 16/87 R |
| 41972 | 11/1937 | Netherlands | 49/455 |

*Primary Examiner*—C. J. Husar
*Assistant Examiner*—Moshe I. Cohen
*Attorney, Agent, or Firm*—Herbert L. Lerner

[57] ABSTRACT

Lower guide for a sliding partition for bath and shower rooms with sliding doors suspended from above extending down into a guide slot of an elongated lower guide member open at the top and confined by two lateral guide walls and a bottom. Pivotal means are provided for swinging the lateral guide wall outward about a horizontal swivel axis with the height of the swung-out wall from its highest point to the bottom of the guide member smaller than the distance between the bottom of the doors and the bottom of the guide member. The swinging guide wall is supported between lateral frame parts with pivot pins extending into vertical slots in each end of the guide wall to permit raising it and then swinging it out. This permits ready cleaning of accumulated dirt in the slot without disassembly and reassembly of the elongated lower guide member.

5 Claims, 7 Drawing Figures

LOWER GUIDE FOR A SLIDING PARTITION

BACKGROUND OF THE INVENTION

1. Field of the Invention

This invention relates to a lower guide for a sliding partition, especially for bath and/or shower rooms, with several sliding doors which are suspended from an upper guide rail and can be pushed together and apart in telescoping fashion and which extend into not more than two guide slots of an elongated lower guide member open at the top and confined by two guide walls and a bottom.

2. Description of the Prior Art

A guide of this type with a single guide slot is known from the German Published Non-Prosecuted Application No. 22 58 179. It is true that there is less danger of dirt accumulating with a smaller number of guide slots, nevertheless dirt does accumulate after an extended period of time. If the sliding doors are to be swung out of the lower guide member laterally for cleaning after an extended period of time, it is necessary with the design according to German Published Non-Prosecuted Application No. 22 58 179 to disassemble the lower guide member.

SUMMARY OF THE INVENTION

An object of the present invention is to provide an elongated lower guide member which will permit swinging the sliding doors laterally without having to disassemble the elongated lower guide member.

With the foregoing and other objects in view, there is provided in accordance with the invention a lower guide for a sliding partition for a wet chamber, particularly bath and shower rooms, with sliding doors which are suspended from an upper guide rail and can be pushed together and apart in telescopic fashion and which doors extend down into a guide slot open at the top and confined by an elongated lower guide member having two lateral guide walls and a bottom, the improvement comprising pivotal means for swinging a lateral guide wall outwardly in the direction from the guide slot about a horizontal swivel axis with the height of the swung-out lateral guide wall measured from its highest point to the bottom of the lower guide member smaller than the distance between the bottom of the doors extending into the guide slot and the bottom of the lower guide member.

In accordance with the invention, there is provided a lower guide wherein the swinging or pivotal guide wall is supported between lateral frame parts with each lateral frame part having, coaxially to the swivel axis, a pivot pin, and wherein associated with each end of the pivotal guide wall is a vertically extending elongated hole into which the pivot pin protrudes and is in the upper end of the elongated hole when the pivotal guide wall is in the normal, not swung-out position; and wherein latch means are provided to prevent the pivotal guide wall from being swung out sideways until it is raised far enough for the pivot pin to reach the lower end of the elongated hole.

Other features which are considered as characteristic for the invention are set forth in the appended claims. Although the invention is illustrated and described herein as embodied in a lower guide for a sliding partition, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description of specific embodiments when read in connection with the accompanying drawings, in which.

DETAILED DESCRIPTION OF THE INVENTION

Figure 1:
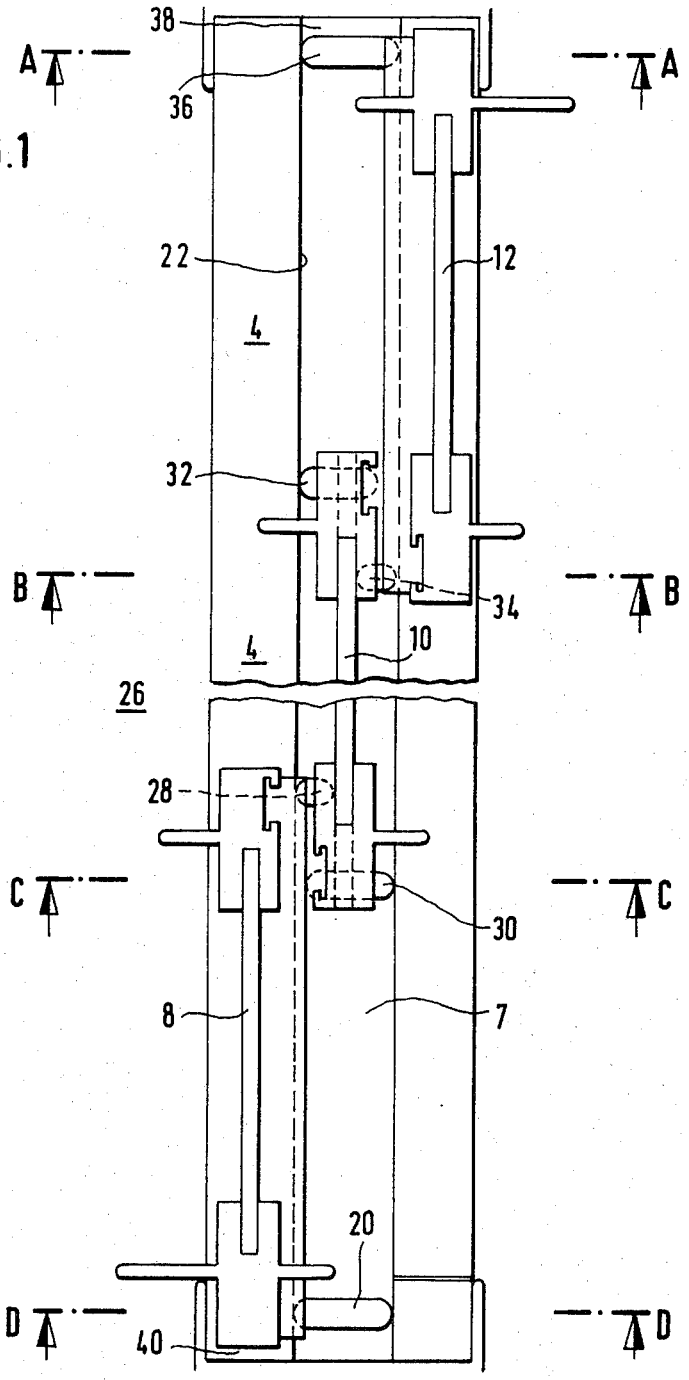
FIG. 1 shows a top view looking down onto the lower guide member, the sliding doors being indicated schematically.

In a lower guide of the type indicated at the outset, at least one of the two guide walls can be swung outwardly about a horizontal geometrical swivel axis. The distance between the sliding doors and the bottom of the guide slot is somewhat larger than the height of the highest portion of the guide wall in the swung-out position above the bottom. Preferably, only a single guide slot is provided. This brings about the desirable advantage that the sliding doors can be swung to one side for instance, to clean them or to unhook them from the upper guide rail, for the purpose for example, to replace panes.

It may also in some instances, be desirable to be able to swing two outer guide walls to make access from both sides possible, or to be able, in a design with two guide slots and a fixed central guide wall, to swing the sliding doors out to both sides.

The hinged guide wall is advantageously mounted between lateral frame parts or posts in such a manner that each lateral frame part has, coaxially with the axis of rotation or swivel axis, a pivot pin which protrudes into a vertically extending elongated hole in the associated end of the guide wall so that in the normal, not swung-out position, the pivot pin is located in the upper end of the elongated hole. A latch is provided to prevent the pivotal guide wall from being swung out laterally as long as it is not lifted up far enough to cause the pivot pin to reach the lower end of the elongated hole. With this design, unintentional swinging-out of the guide member is impossible. Instead, the pivotal guide member must first be lifted by a small distance, to disengage the latch thereby making swinging-out possible.

The latch advantageously consists of each lateral frame part having, eccentrically to the pivot axis, a latching pin, which a hook attached to the corresponding end of the pivotal guide wall engages from above. This hook can be formed, for instance, by milling out the end face of the guide wall in the shape of a hook. If the guide wall is raised, the pivot pin reaches the lower end of the elongated hole and the latching pin gets free of the hook, so that it becomes possible to make the swing to the outside. The kinematic inverse of the design described is, of course, also possible, where the pivot pins and latching pins are not arranged in the lateral frame parts of partition posts but at the guide wall itself. The operation is then the same.

Swinging the pivotal guide wall back to its normal position brings about a gap under it. This hinged or pivotal guide wall is advantageously arranged on the side of the wet room so that the water that has penetrated into the guide slot can be returned through the gap back into the wet room. Such a design is advantageously characterized by the feature that the bottom of the guide slot is continued outward or extended under the pivotal guide wall and is inclined from the guide slot outwardly, so that the water runs off toward the wet space. "Outward" refers here to the guide member. With respect to the sliding partition, the wet room side is the inside.

Figure 5:
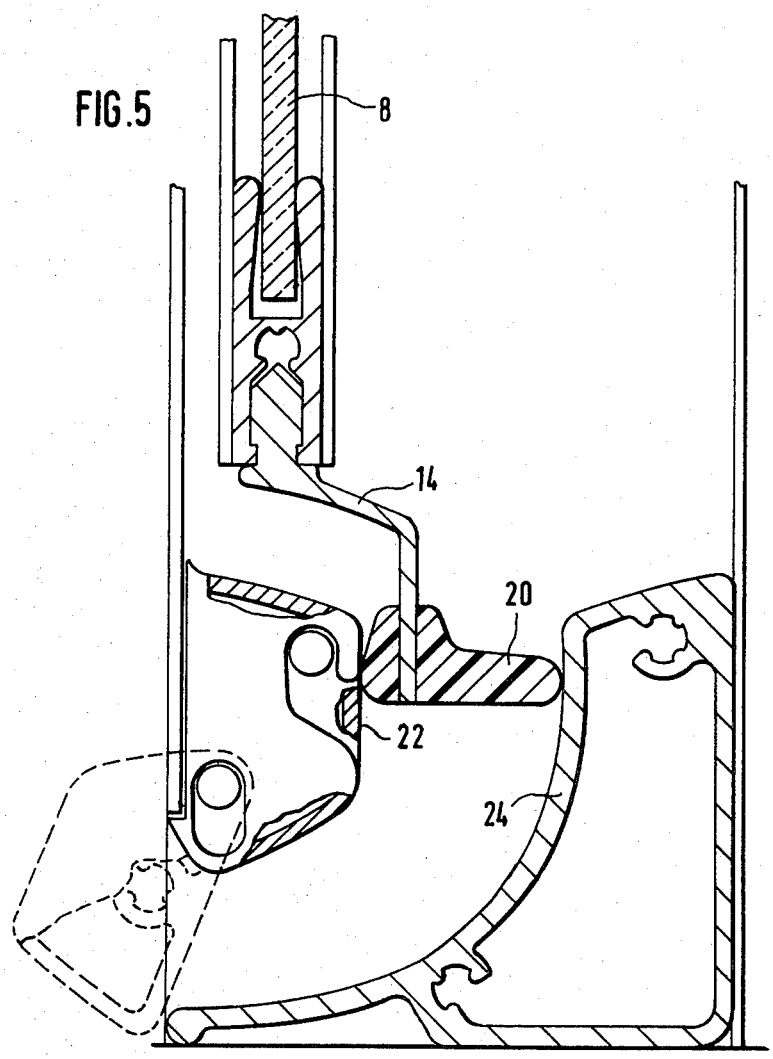
FIG. 5 is a sectional view of FIG. 1 taken along the line D—D.
Figure 6:
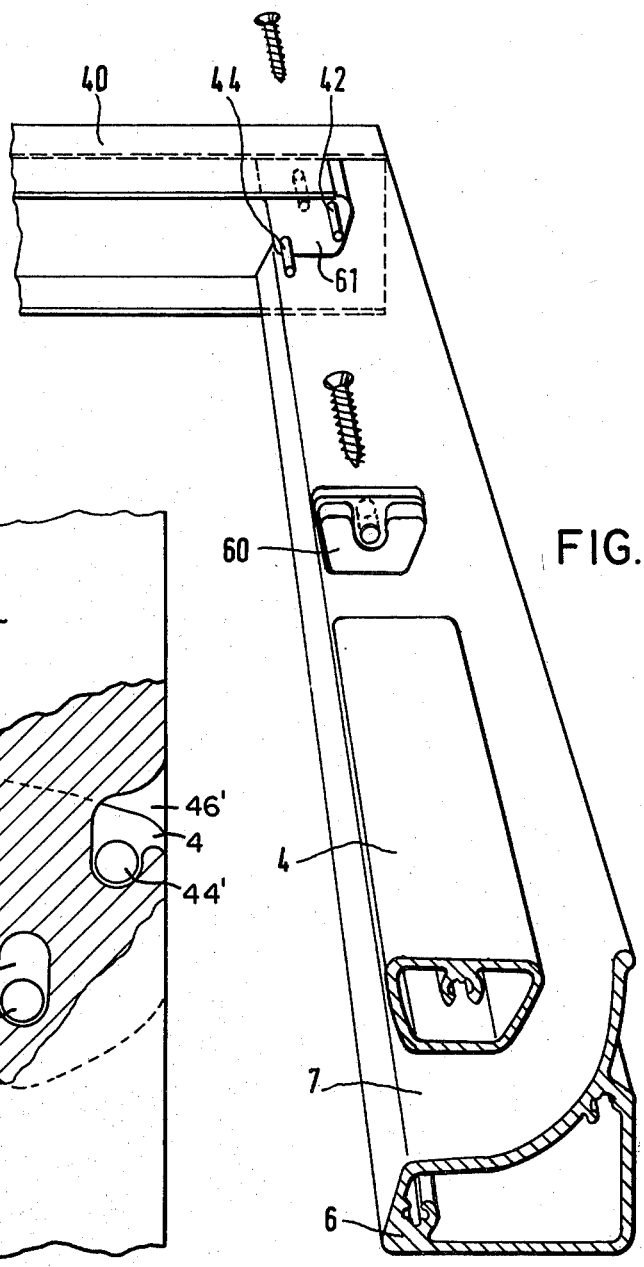
FIG. 6 is a perspective view of the lower guide member.
Figure 7:
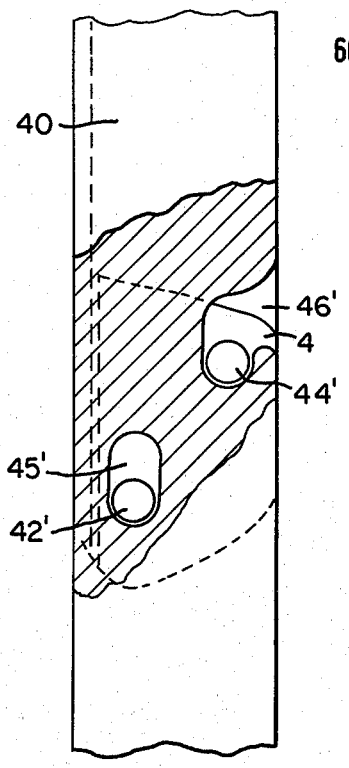
FIG. 7 is another embodiment of the invention similar to FIG. 2.

An advantageous embodiment example of the invention is shown diagrammatically in FIGS. 1–6; and an embodiment which is a kinematic inverse thereof in FIG. 7.

Figure 3:
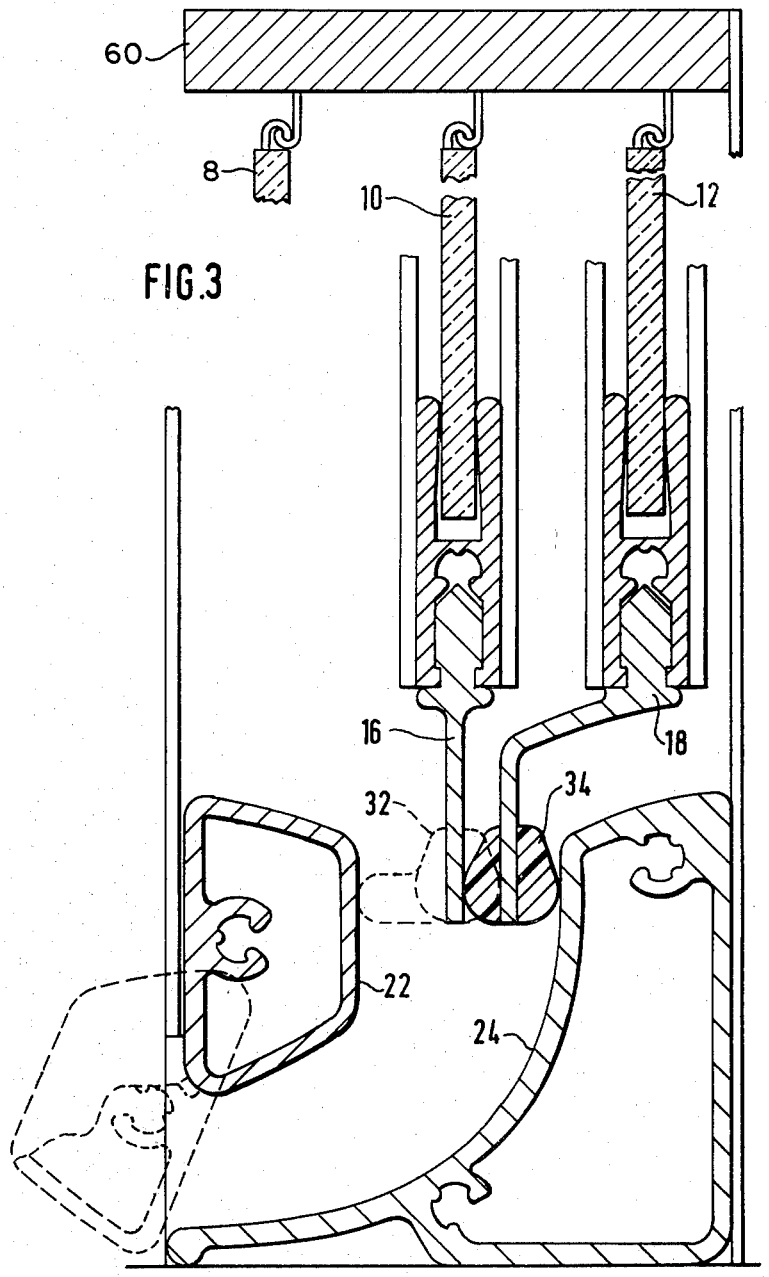
FIG. 3 is a sectional view of FIG. 1 taken along the line B—B.

Referring to the drawings, a lower guide member 2 has two lateral guide walls 4 and 6, which confine a single guide slot 7 between them. Three sliding doors 8, 10 and 12 are suspended from an upper guide rail 60 (FIG. 3). At the bottom, these sliding doors carry, via connecting pieces 14, 16 and 18, spacers, by which they are guided at each other and at the guide walls 4 and 6, respectively.

Figure 4:
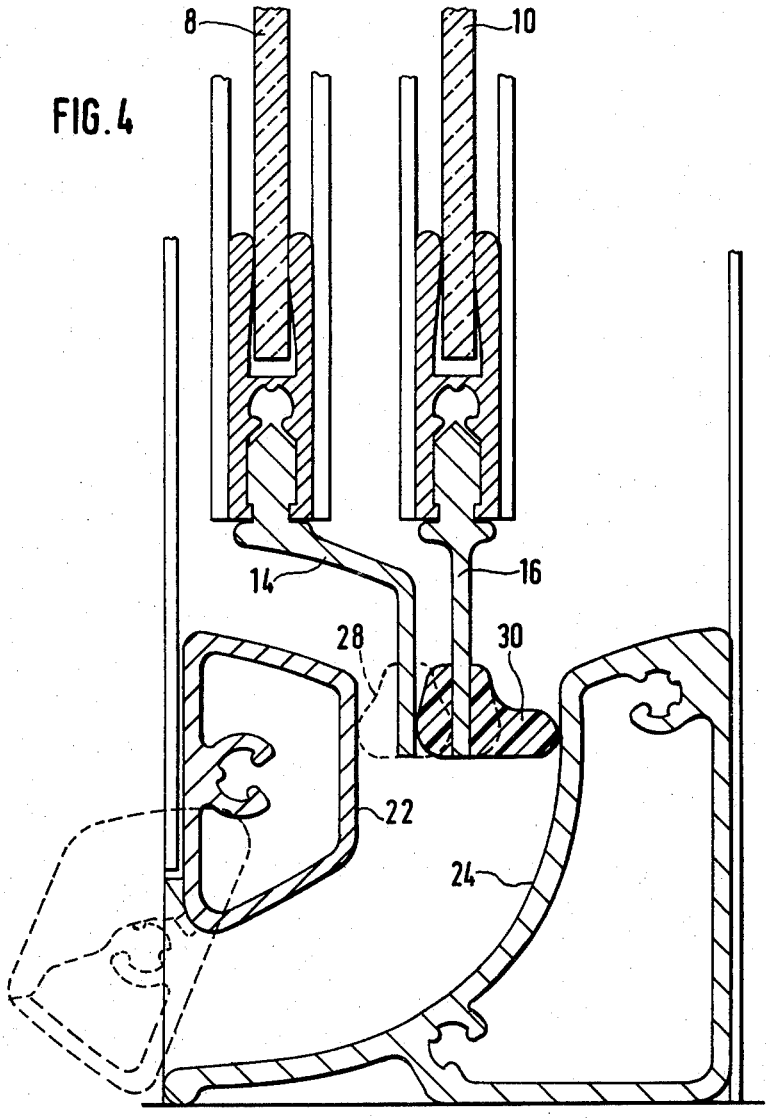
FIG. 4 is a sectional view of FIG. 1 taken along the line C—C.

The inner sliding door 8 carries at one end a spacer 20 which rests against the inside surfaces 22 and 24 of the guide walls 4 and 6 in a sliding relationship (FIGS. 1, 5). In FIGS. 3 and 4, the spacers 28 and 32 which lie behind the cross section plane, are indicated by dashed lines.

At the other end, the inner sliding door 8 which is adjacent to the wet room 26, carries a smaller spacer 28 which rests on the one hand against the inside surface 22 of the guide wall 4 and on the other hand, against the connecting piece 16 of the middle sliding door 10 (FIGS. 1, 4). The middle sliding door 10 carries at one end a spacer 30 which rests against the connecting piece 14 of the inner sliding door 8 and, against the inside surface 24 of the guide wall 6 in a sliding relationship.

Figure 2:
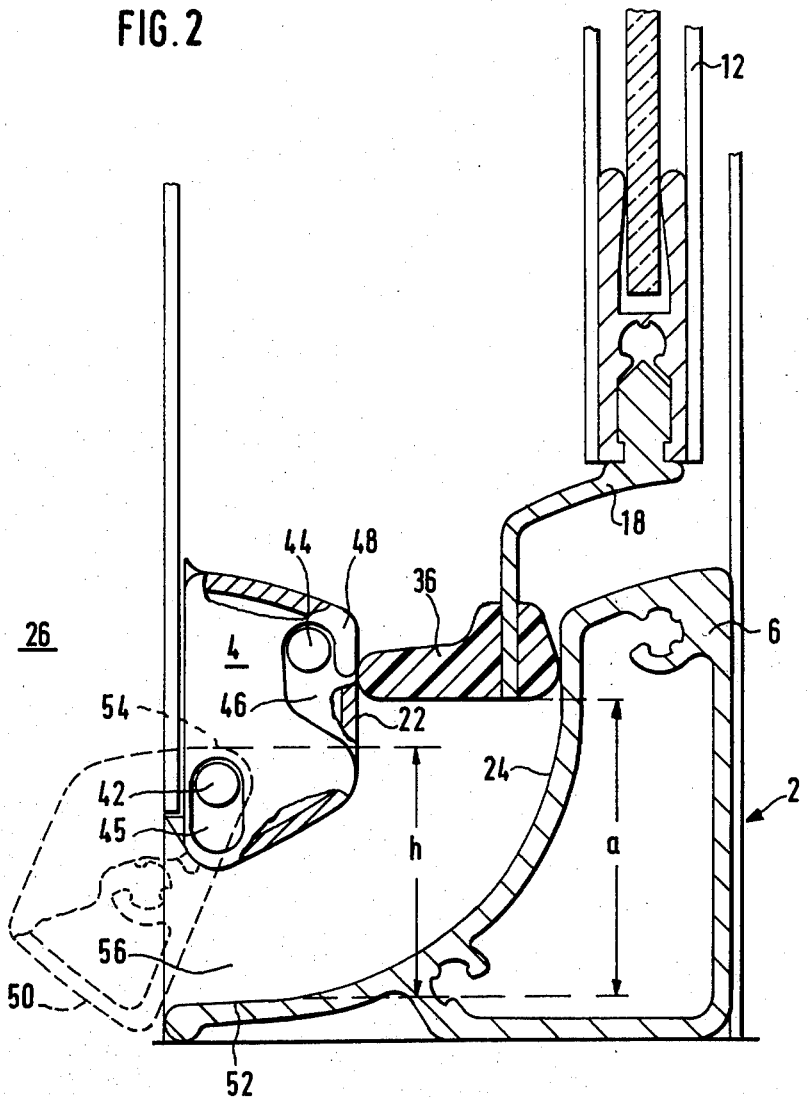
FIG. 2 is a sectional view of FIG. 1 taken along the line A—A.

At its other end, the middle sliding door 10 carries a spacer 32 which rests against the inner surface 22 of the guide wall 4 and against the connecting piece 18 of the outer (as referred to the wet room 26) sliding door 12 (FIGS. 1, 3). The outer sliding door 12, finally, carries at its one end a spacer 34 which rests against the connecting piece 16 of the middle sliding door 10 and against the inner surface 24 of the guide wall 6. At its other end, the outer sliding door 12 carries a spacer 36 which rests against the inner surface 22 of the guide wall 4 and against the inner surface 24 of the guide wall 6 (FIGS. 1, 2).

The three sliding doors 8, 10 and 12 are guided in the single guide slot 7 by the six spacers 20, 28, 30, 32, 34 and 36.

The two guide walls 4 and 6 are mounted between lateral frame parts 38 and 40 (FIG. 1). These lateral frame parts 38, 40 each carry a pivot pin 42 (FIGS. 2, 6). Further up and slightly displaced in the direction of the guide slot 7, each lateral frame part also has a latching pin 44. A vertical elongated hole 45 which is associated with a pivot pin 42, is arranged in the end face of the end of the guide wall 4, adjacent to lateral frame parts 38, 40. In addition, the surface associated with lateral frame parts 38, 40 of the end of the guide wall 4 has a hook-shaped cutout 46 which leaves a hook 48.

If the guide wall 4 is lifted somewhat, the elongated hole 45 slides over the pivot pin 42 until the latter is located in the lower end of the elongated hole 45. The latching pin 44 then sits in the cutout 46 in its lower, open part so that the hook 48 no longer extends over this latching pin. The guide wall 4 can then be swung into the position 50, indicated by dashed lines (FIG. 2). In this position, the distance a between the sliding doors (i.e., in the design shown, between the spacers 20, 28, 30, 32, 34, 36) and the bottom of the guide slot 7 is larger than the distance h between the highest portion 54 of the guide wall 4 in the position 50, shown in dotted lines.

The sliding doors 8, 10 and 12 can therefore be swung out without being impeded by the guide wall 4.

Between the bottom 52 of the guide slot on the one hand and the guide wall 4 on the other hand, there is a gap 56. Through this gap, water that has penetrated into the guide slot 7 can flow off toward the wet room 26 via the bottom 52 which is inclined toward the wet room side 26.

For production and installation reasons, it is desirable to terminate the pivotal guide wall 4 on both sides by a plate 60 which can be screwed on and in which the elongated hole 45 and the cutout 46 as well as the hook 48 are located (FIG. 6). Similarly, a support plate which carries the pivot pin 42 and the latching pin 44, is inserted into the lateral frame parts 38, 40 and fastened by means of a screw connection.

In FIG. 7 there is shown an embodiment of the invention in a view similar to that of FIG. 2 exhibiting a kinematic inverse of the aforedescribed embodiment. In FIG. 7, the pivot pin 42' and the latching pin 44' are not arranged in the lateral frame part 40, but rather in the guide wall 4 per se. On the other hand, the elongated hole 45' and cutout 46' are formed in the lateral frame part 40.

There is claimed:

1. Lower guide for a sliding partition for a wet chamber, particularly bath and shower rooms, with sliding doors which are suspended from an upper guide rail and can be pushed together and apart in telescopic fashion and which doors extend down into a guide slot open at the top and confined by an elongated lower guide member having two lateral guide walls and a bottom, the improvement comprising pivotal means for swinging a lateral guide wall outwardly in the direction from the guide slot about a horizontal swivel axis with the height of the swung-out lateral guide wall measured from its highest point to the bottom of the lower guide member smaller than the distance between the bottom of the doors extending into the guide slot and the bottom of the lower guide member, the swinging guide wall being supported between lateral frame parts with each lateral frame part having, coaxially with the swivel axis, a pivot pin, and, associated with each end of the swinging guide wall, there is a vertically extending elongated hole into which the pivot pin protrudes and is in the upper end of the elongated hole when the swinging guide wall is in the normal not swung-out position; and latch means being provided to prevent the pivotal guide wall from being swung out sideways until it is raised far enough for the pivot pin to reach the lower end of the elongated hole.

2. Lower guide according to claim 1, wherein each lateral frame part carries, eccentrically to the swivel axis, a latching pin which is engaged from the top by a hook arranged at the corresponding end of the swinging guide wall.

3. Lower guide for a sliding partition for a wet chamber, particularly bath and shower rooms, with sliding doors which are suspended from an upper guide rail and can be pushed together and apart in telescopic fashion and which doors extend down into a guide slot open at the top and confined by an elongated lower guide member having two lateral guide walls and a bottom, the improvement comprising pivotal means for swinging a lateral guide wall outwardly in the direction from the guide slot about a horizontal swivel axis with the height of the swung-out lateral guide wall measured from its highest point to the bottom of the lower guide member smaller than the distance between the bottom of the doors extending into the guide slot and the bottom of the lower guide member, the swinging guide wall being supported between lateral frame parts; each end of the swinging guide wall carrying, coaxially with the swivel axis, a pivot pin which protrudes into a vertically extending elongated hole in the corresponding lateral frame part; and the pivot pin being in the lower end of the elongated hole in the not swung-out position of the swinging guide wall, to prevent the swinging guide wall from being swung out sideways until it is raised far enough for the pivot pin to reach the upper end of the elongated hole.

4. Lower guide according to claim 3, wherein each end of the swinging guide wall carries, eccentrically to the swivel axis, a latching pin, which is engaged from below by a hook attached to the corresponding frame part.

5. Lower guide according to claim 1 or 3 wherein the bottom of the lower guide member extends outwardly under the swinging guide wall with the bottom of the swinging guide wall spaced from the bottom of the lower guide member to leave a gap therebetween and wherein the bottom of the lower guide member is inclined outwardly from the guide slot toward the wet chamber to permit water which has penetrated into the guide slot to flow through the gap into the wet chamber.

* * * * *